US005077862A

United States Patent [19]

Rench

[11] Patent Number: 5,077,862

[45] Date of Patent: Jan. 7, 1992

[54] CARPET CLEANING MACHINE WITH EDGE-MOUNTED VACUUM NOZZLE

[75] Inventor: Geoffrey B. Rench, Racine, Wis.

[73] Assignee: Racine Industries, Inc., Racine, Wis.

[21] Appl. No.: 607,254

[22] Filed: Oct. 31, 1990

[51] Int. Cl.[5] ..... A47L 5/30

[52] U.S. Cl. ..... 15/384; 15/320; 15/415.1; 15/418

[58] Field of Search ..... 15/320, 384, 418–421

[56] References Cited

U.S. PATENT DOCUMENTS

| | | | |
|---|---|---|---|
| 574,850 | 1/1897 | Carrier . | |
| 1,079,378 | 11/1913 | Templin . | |
| 1,211,902 | 1/1917 | Warner . | |
| 1,417,768 | 5/1922 | Radimak | 15/320 X |
| 1,596,041 | 8/1926 | Young . | |
| 1,891,504 | 12/1932 | Smellie . | |
| 1,939,579 | 12/1933 | Swartz | 15/384 X |
| 2,003,215 | 5/1935 | Nadig | 15/50 |
| 2,680,260 | 6/1954 | Danielson et al. | 15/50 |
| 3,540,072 | 11/1970 | Wolter et al. | 15/320 |
| 3,624,668 | 11/1971 | Krause | 15/322 |
| 3,624,861 | 12/1971 | Freiheit | 15/320 |
| 3,840,935 | 10/1974 | Fitzgerald, Jr. et al. | 15/322 |
| 4,000,538 | 1/1977 | Tissier | 15/320 |
| 4,267,617 | 5/1981 | Brown et al. | 15/320 |
| 4,426,751 | 1/1984 | Nordeen | 15/384 |
| 4,817,233 | 4/1989 | Waldhauser | 15/320 |

*Primary Examiner*—Chris K. Moore

*Attorney, Agent, or Firm*—Jansson & Shupe, Ltd.

[57] ABSTRACT

An improved carpet cleaning machine includes front and rear counter-revolving brushes for stroking substantially-dry carpet cleaning granules into and across the carpet fibers. A shroud is mounted adjacent the brushes and has a front portion and a rear portion, each of which is spaced from its adjacent brush to define a granule passage through which granules cast by the counter-revolving brushes are re-deposited on the carpet. Each such portion also has an edge spaced above the carpet to define a granule exit opening between the edge and the carpet. Front and rear vacuum nozzles each have an inlet for receiving granules to be removed from the carpet. Each nozzle inlet is substantially positionable at a granule exit opening to substantially block such exit opening. When the passages and exit opening are unobstructed, the machine is used to stroke granules across carpet fibers and re-distribute granules for further cleaning of the carpet. With the nozzle inlets repositioned to block the exit openings following completion of carpet cleaning, the granules are removed by vacuuming.

17 Claims, 4 Drawing Sheets

CARPET CLEANING MACHINE WITH EDGE-MOUNTED VACUUM NOZZLE

FIELD OF THE INVENTION

This invention relates generally to carpet cleaning machines and, more particularly, to a carpet cleaning machine which facilitates application and re-distribution of cleaning granules to a carpet and has edge-mounted vacuum nozzles mounted for selective positioning to subsequently remove such granules by vacuuming or to provide a carpet-cleaning vacuum capability per se.

BACKGROUND OF THE INVENTION

The three primary approaches used to clean commercial and residential carpets are steam or hot water, foam and dry systems. Dry-type carpet cleaning systems are further divided into two broad categories, namely, those using a dry or substantially dry powder and those using granules which are slightly moistened with cleaning solvents for dirt removal. The inventive machine has utility for both categories of dry systems but relates primarily to those using granules rather than powder. Such machine also has utility in situations where only carpet vacuuming is performed. That is, its aggressive, long-bristled brushes are highly effective in removing loose sand and other soil not requiring the application of solvent-bearing material.

Of the dry granular carpet cleaning systems, the best known and most widely used is the HOST® dry extraction system offered by Racine Industries, Inc. of Racine, Wis. The HOST® system applies granules to carpet fibers using a machine as shown in Rench et al. U.S Pat. Nos. 2,842,788 and 2,961,673. Such machine, sold under the HOST® trademark, is devoid of vacuum capability and has a pair of spaced brushes which counter-rotate at relatively low speed (about 350 rpm) to stroke the cleaning granules into, through and across carpet fibers. The granules are referred to as "dry" and are substantially so although moistened with cleaning solvents. When stroked as described, these granules "scrub" soil and dirt from such fibers including oily and non-oily soil. The carpet is cleaned by working the HOST® machine across it in different directions. During the cleaning process, granules migrate to the carpet backing adjacent the base of the fiber. Granules also adhere lightly to the fibers along their lengths. Following cleaning, conventional carpet vacuum machines are used for removing the dirt-ladened granules.

Conventional vacuum machines are not ideally suited for the removal of such dirt-ladened granules although such machines do a reasonably acceptable job of such removal. In particular, most such machines employ a single "beater bar" which rotates at high speed and which uses spaced rows of relatively short bristles. A few such machines have two counter-revolving beater bars which are constructed and operate in much the same way. Such high speed beater bars with short bristles are more effective in removing granules near the tops of the fibers but significantly less so as to granules which are "deep down" in the carpet.

Another disadvantage with many such conventional carpet vacuuming machines is that a shroud surrounds at least a portion of the periphery of the beater bars and such shroud is very closely spaced to the bars or may lightly contact the bar bristles. Redistribution of granules during carpet cleaning is an important function since such granules should be repeatedly brushed through the carpet fibers. The absence of a significant space between the bristles and the shrouds of many conventional machines prevents dry carpet granules from being cast about by the brushes during the cleaning operation Yet another disadvantage of such machines is that the beater bar(s) are often driven by smooth-surfaced, flexible rubber belts which wrap partially around the bar. The solvent used to moisten the cleaning granules often causes the belt to slip, thereby temporarily disabling the bar(s).

Still another disadvantage is that vacuum nozzles on most such machines face directly or angularly downward toward the carpet and operate simultaneously with the beater bars. Therefore, it is not possible to first brush the granules into the carpet and then later remove them by independently-operable vacuum nozzles Further, the embodiment of carpet brushing and carpet vacuuming capabilities in two separate machines means that both such machines must be available to complete the cleaning process. This represents an extra equipment expense and for the professional carpet cleaner, it also represents added time (reflected in employee wages) required to get the necessary machines to the job site and to later remove such machines Examples of conventional vacuum machines are shown in U.S. Pat. Nos. 1,891,504 and 4,426,751.

In addition to the foregoing, several other patents show machines which combine brush and vacuum features for removing dirt from a surface. Nordeen U.S. Pat. No. 4,426,751 and Smellie U.S. Pat. No. 1,891,504 show carpet cleaning machines having two counter-revolving beater bars with brushes thereon. Shrouds are in very close proximity to the tips of the brushes and extend around a portion of the bar perimeters. In the nozzle shown in the Nordeen patent, at least a portion of the shroud must contact the beater bar bristles in that the shrouds are said to strip away material which clings to the periphery of the brushes Vacuum inlets are positioned forward and aft of the bars and carpet brushing and vacuuming occur simultaneously.

The machine shown in Swiss Patent No. 96633 has a single revolving brush and a shroud spaced from the brush and extending more than halfway around its periphery. The machine has two vacuum nozzles, the inlets for which face downward toward the surface to be cleaned and are spaced above such surface Wolter et al. U.S. Pat. No. 3,540,072 shows a floor scrubbing machine having two machine-supporting, counter-revolving brushes, the rotational axes of which are normal to the floor. Two bar-like, downward-facing suction nozzles are mounted one each crosswise at the front and rear of the machine. These nozzles can be raised during scrubbing operations and lowered for drying the wet floor. The suction air stream can also be disabled during scrubbing.

Waldhauser U.S. Pat. No. 4,817,233 shows a floor scrubber having downward-facing, squeegee-type vacuum nozzles, one each positioned forward and aft of a single brush. The vacuum passages are defined in part by a shroud positioned in close proximity to the brush. One of the two nozzles is always closed by an inwardly-turned flexible nozzle lip. The particular nozzle which is closed is a function of the direction of machine travel.

Warner U.S. Pat. No. 1,211,902 shows a railway track cleaner uses a revolving drum with outwardly extending blades to clean the track. A U-shaped shroud has a pressurized air inlet and a vacuum nozzle whereby cleaning air may be introduced into and removed from the shroud.

A type of system used for cleaning carpets with powder is the DRYTECH cleaning machine sold by Sears, Roebuck & Company. The machine has a self-contained vacuum capability and one beater bar with several rows of short-bristled brushes. Such bar is within a shroud which generally conforms to the shape of the bar and by which vacuum is selectively applied. As the brush alone is rotated at high speed, powder is dispensed through two slits, one on either side of the bar between the bar and the shroud. Later, the vacuum is actuated and dry powder (with dirt entrained) is dislodged by the brush and drawn away by vacuum.

Another type of machine used to apply dry cleaning powder to carpet fiber is made by Clarke-Gravely Corp. of Muskegon, Mich. and sold as the CLARKE CAPTURE carpet cleaning system. Such machine distributes cleaning powder onto the carpet and works the powder into and through the carpet fibers using a round, disk-like scrubber brush, the axis of rotation of which is normal to the carpet surface The machine vacuum system operates to reduce dust. After cleaning, a separate conventional vacuum machine is used to remove the powder.

None of the machines discussed above provide the advantages of a dual machine capability to first apply dry carpet cleaning granules using long-bristled, relatively stiff counter-revolving brushes, permit such granules to be freely redistributed along passages and through granule exit openings and then remove the dirt-ladened granules from the carpet by vacuuming. Earlier workers in this field have failed to understand how to make and deploy independently-operable vacuum nozzles to obstruct the openings and passages for granule removal subsequent to carpet cleaning. A machine having such capabilities would be an important advance in the art.

OBJECTS OF THE INVENTION

It is an object of this invention to overcome some of the problems and shortcomings of the prior art.

Another object of this invention is to provide an improved carpet cleaning machine for applying substantially dry cleaning granules to the carpet and later removing such granules by vacuum.

Another object of this invention is to provide an improved carpet cleaning machine having passages and exit openings which facilitate redistribution of cleaning granules during carpet cleaning and further having a separately-operable vacuum capability for removing such granules following cleaning Still another object of this invention is to provide an improved carpet cleaning machine having vacuum nozzles which can be positioned to selectively obstruct such passages and exit openings during vacuuming operations.

Yet another object of this invention is to provide an improved carpet cleaning machine wherein such vacuum nozzles open substantially directly toward the trajectories of granules being cast about in the passages. These and other important objects will be apparent from the descriptions of this invention which follow.

SUMMARY OF THE INVENTION

The HOST ® carpet cleaning machine as described above and as depicted in the aforementioned Rench et al. patents has a pair of spaced counter-revolving brushes, the bristles of which are relatively long, relatively stiff and substantially evenly distributed. Such brush arrangement has long been demonstrated to be highly effective in brushing the HOST ® dry cleaning granules into, through and across carpet fibers, even relatively long carpet fibers. Such brushes are also very effective in "digging" granules out of the carpet including those deep-down granules which have migrated into the carpet to the backing. The brushes redistribute the granules about the carpet by casting them from bristle tips to be again worked into and out of the fibers.

A shroud is placed over and partially around the brushes and in a spaced relationship from the brushes. The shroud has front and rear portions which conform to the shape of the brushes and which terminate in edges spaced above the carpet. When the granules are cast or thrown by the bristles, they move along the passages between the brushes and the shroud and emerge from the granule exit openings defined between the edges and the carpet. The granules are thereby redistributed on the carpet for repetitive cleaning Granule redistribution is an important function when cleaning a carpet using the dry granular method.

The inventive machine takes advantage of this granule redistribution effect and uses a vacuum nozzle mounted (or mountable) at each shroud edge. The nozzles may be positioned to catch and vacuum away granules moving along the passages after carpet cleaning operations are complete.

More specifically, the inventive machine includes front and rear counter-revolving brushes for stroking the granules into and across the carpet fibers. A shroud is mounted adjacent the brushes and has a front portion and a rear portion, each of which is spaced from its adjacent brush to define a granule passage through which granules cast by the counter-revolving brushes are re-deposited on the carpet. Each such portion also has an edge spaced above the carpet to define a granule exit opening between the edge and the carpet.

The machine further includes front and rear vacuum nozzles, each having an inlet for receiving granules to be removed from the carpet. Each nozzle inlet is selectively positionable at a granule exit opening to substantially block such exit opening. When the passages and exit openings are unobstructed, the machine is used to apply and re-distribute granules for cleaning the carpet. With the nozzle inlets repositioned to substantially block the exit openings following completion of carpet cleaning, the granules are removed by vacuuming.

In a highly preferred embodiment, the length of each nozzle is about equal to the width of the shroud. Each nozzle has an inner lip which is in a closely-proximate, non-contacting relationship to a brush when the inlet of the nozzle is positioned in a granule passage. The inlet of each nozzle generally defines a plane oriented to intersect the trajectories traced by the granules moving along a passage The nozzles thereby "catch" and entrain granules as they approach the now-blocked exit openings. Such nozzles operate simultaneously and are operable independently of the operation of the brushes.

To permit selective nozzle positioning (for carpet cleaning or for granule removal), each nozzle is pivotably coupled to the machine at a separate edge of the shroud. Alternately, each nozzle is detachably attached to such an edge and simply removed during cleaning operations.

The moving air stream in the passages helps carry granules along and re-distribute them on the carpet. Therefore, when vacuuming, granule removal is expedited if the velocity of the vacuum air stream in the passages is maintained at a relatively high value. This is achieved in part by forming the nozzle so that its interior edge is in close proximity to the brush when the nozzle is positioned for vacuuming. Further, each nozzle includes a lower lip in air-flow restricting relationship to the carpet when such nozzle is positioned for vacuuming granules. Air flow is restricted when such lower lip is in closely proximate, non-contacting relationship to the carpet or, alternately, is in contact with the carpet. Such arrangement also helps reduce the introduction of vagrant air, i.e., air which has not flowed along at least a portion of the passages to entrain granules.

In a highly preferred embodiment, the vacuum capability of the nozzles is provided by a motor separate from that used to power the counter-revolving brushes. Such vacuum motor may be mounted on the machine or may be embodied in a separate vacuum-creating machine connected to the carpet cleaning machine by a flexible hose. The vacuum-creating machine may be of the portable, freestanding canister type or mounted on a motor vehicle.

The preferred machine is devoid of separate support wheels. That is, the brush bristles are relatively stiff and substantially continuously disposed about the brush. Such bristles deflect only slightly during machine operation and the machine is supported substantially entirely by the counter-revolving brushes when in operation. The aforementioned Rench et al. patents are incorporated herein by reference for their teaching regarding the basic structure used to make the inventive machine.

DETAILED DESCRIPTION OF PREFERRED EMBODIMENTS

The FIGURES show the improved carpet cleaning machine 10 in accordance with the invention.

Understanding of the inventive machine 10 will be aided by an expanded explanation of the carpet cleaning system with which it is particularly suited to be used. However, it is to be appreciated that there are other granular-type dry carpet cleaning systems in use and the machine 10 will also work well with such systems.

The Host® Carpet Cleaning System

Figure 3A:
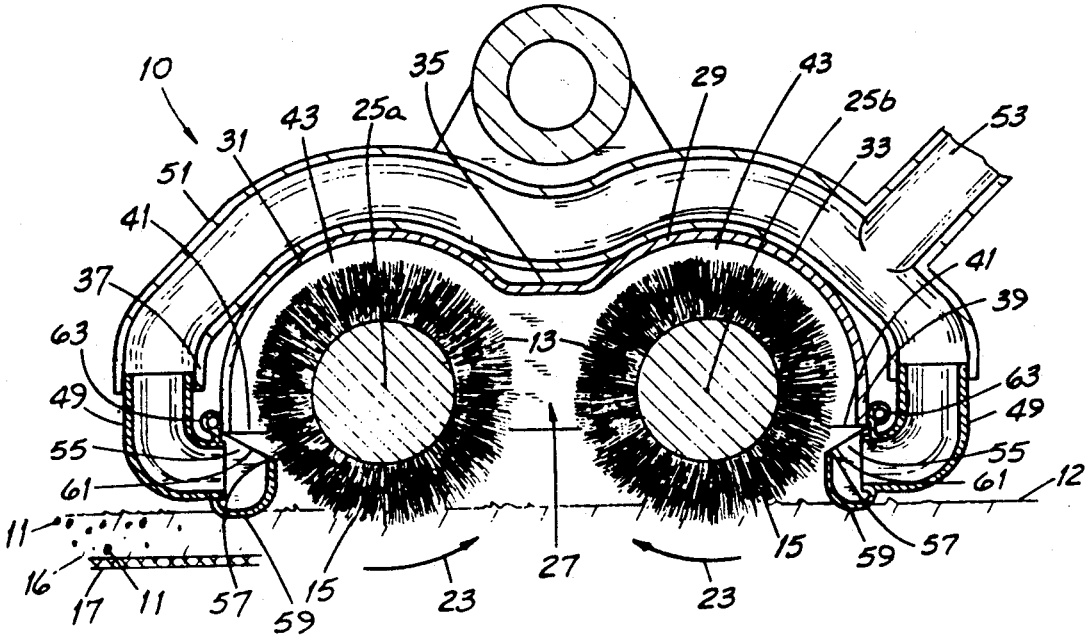
FIG. 3A is a cross-sectional side elevation view of the machine shown in FIG. 1, taken along the viewing plane 3—3 thereof.

Referring to FIG. 3A, the HOST® dry carpet cleaning system uses cleaning granules 11 which are slightly moistened with cleaning solvents These granules 11 are sprinkled on the carpet 12 by hand (much as one distributes grass seed upon turf) or by using an applicator drum designed for the purpose. After such granules 11 are relatively evenly distributed on the carpet 12, the counter-revolving brushes 13 of the machine 10 are actuated and their long, relatively stiff bristles 15 work the moistened granules 11 deep into the carpet pile and across the carpet fibers 16. These granules 11 are like thousands of tiny absorbing "scrubbers" which collect and retain dirt thereon. To achieve optimum cleaning, the machine 10 (with vacuum de-activated) is worked across the carpet 12 in a forward and back motion which also includes lateral movement The pattern thereby defined by the machine 10 is saw-toothed in shape. After completely covering and cleaning the carpet 12 in that manner, the machine 10 is re-oriented so that the direction of the forward and back motion is generally perpendicular to that used initially. The machine 10 may also be again re-oriented so that the direction of the forward and back motion is at about a 45° angle to those used previously.

As a result of this activity, the carpet fibers 16 are well cleaned and the dirt-ladened granules 11 appear not only visibly at the top of the carpet 12 but also along the carpet fibers 16 and at the lower ends of the fibers 16 where they are joined to the carpet backing 17. These cleaning granules 11 have been so positioned by the action of the relatively stiff long bristled brushes 13 which repeatedly "stroke" the granules 11 across the fibers 16 by continuous redistribution and rebrushing.

Following such carpet cleaning, the granules 11 are removed by the machine 10 in the manner described below.

The Inventive Machine

The machine 10 is shown in FIGS. 1, 2, 3A and 3B and includes an electric motor 19 coupled to a pair of counter-revolving brushes 13 by a plurality of gear trains within the gear housing 21. Brush rotation is in the directions shown by the arrows 23. The axes of rotation **25*a*, 25*b* of the brushes 13 are generally parallel and located so that a space 27 is defined between the brushes 13. Each brush 13 is generally cylindrical and made of bristle tufts closely spaced to one another. The resulting appearance of the outer perimeter of each brush 13 is relatively uniform without significant spaces between tufts and with essentially no spaces delineating rows or groupings of bristles 15**.

The bristles 15 are rather stiff and yield or bend only slightly as they engage the carpet fibers 16 and stroke the granules 11 into and through the fibers 16. The exposed length of the bristles 15 is about one-half of the radius of the brush 13. Because the weight of the machine 10 is supported entirely by the brushes 13 rotating in opposite directions, the machine 10 has little or no tendency to creep or drift across the carpet 11.

Interposed between the brushes 13 and the drive motor 19 is a protective shield or shroud 29 having a front portion 31, a rear portion 33 and a horizontal, generally planar platform 35 between the portions 31, 33. Each portion 31, 33 is shaped to conform generally to the curvature of the brush 13 associated therewith and terminates in a front edge 37 and a rear edge 39. These edges 37, 39 are generally parallel to and spaced above the carpet 11.

When the HOST® dry carpet cleaning granules 11 are initially distributed on the carpet 12 to be cleaned, such distribution is relatively even (or should be) and devoid of any significant mounds of such granules 11. When the motor 19 is actuated to drive the counter-revolving brushes 13, the granules 11 are worked into the carpet 12 and across the carpet fibers 16 to remove dirt therefrom. As the granules 11 are urged out of the carpet 12, they are "carried" at or near the tips of the bristles 15.

Most of the granules 11 are thrown or cast by the bristles 15 as the brushes 13 rotate. The trajectory traced by a particular granule 11 depends upon the instant at which that granule 11 is cast from a bristle 15. However, many granules 11 are cast toward the bottom surface of the shroud 29 and many other granules 11 are thrown directly out of the exit openings 41 between the edges 37, 39 and the carpet 12. Most of those granules 11 which contact the shroud 29 continue to move along the passage 43 (sometimes ricocheting between the brush 13 and the shroud 29) and eventually emerge at an exit opening 41. Therefore, the passages 43 and the exit openings 41 between the front and rear edges 37, 39 respectively, of the shroud 29 and the carpet 12 are important to granule redistribution. The machine 10 takes advantage of this granule redistribution feature to effectively vacuum away granules or to simply loosen and remove certain types of soiling without the application of granules 11.

Figure 4:
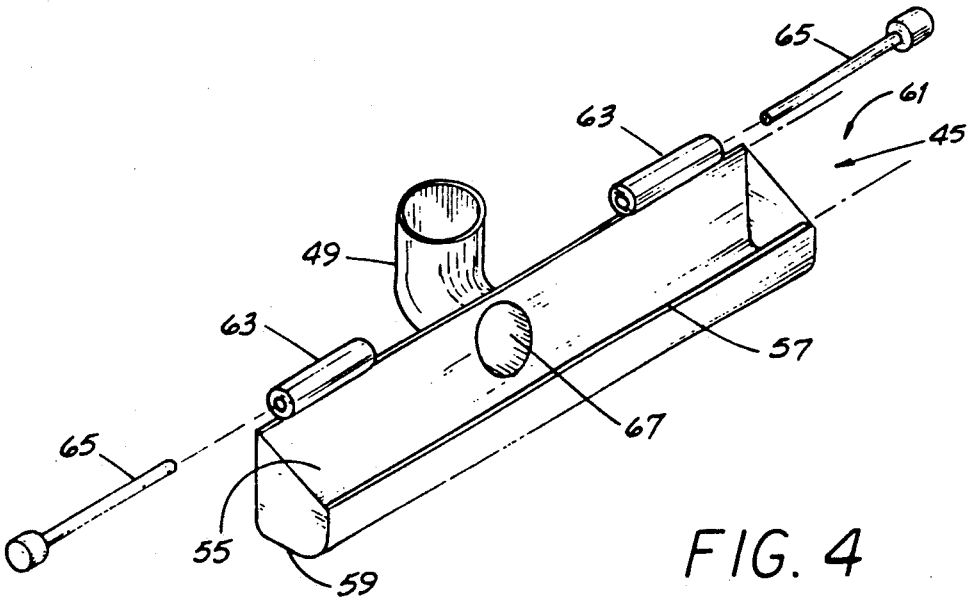
FIG. 4 is a perspective view of a vacuum nozzle and attachment pins used with the inventive machine.

The improved machine 10 has nozzles 45 including a front vacuum nozzle **45*a* and a rear vacuum nozzle 45*b* connected to one another and thence to a vacuum-creating machine 47 using coupling elbows 49, a conduit 51 and a connector 53. Referring also to FIG. 4, when mounted for vacuuming, the inlet 55 of each nozzle 45*a* and 45*b* is positioned at a granule exit opening 41 and substantially blocks such opening 41. As described in greater detail below, such nozzles 45** are movable (by detachment or pivoting) to permit granule redistribution during the carpet cleaning process.

Figure 3B:
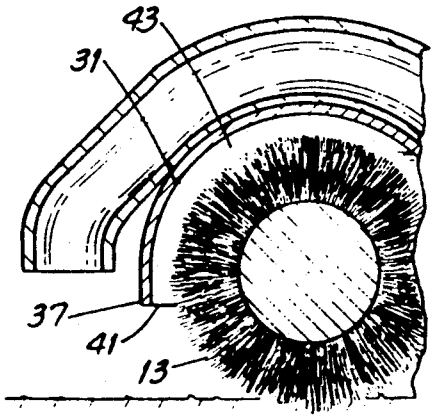
FIG. 3B is cross-sectional side elevation view of a portion of the machine shown in FIG. 3A with parts omitted to show certain details and with other parts broken away.
Figure 2:
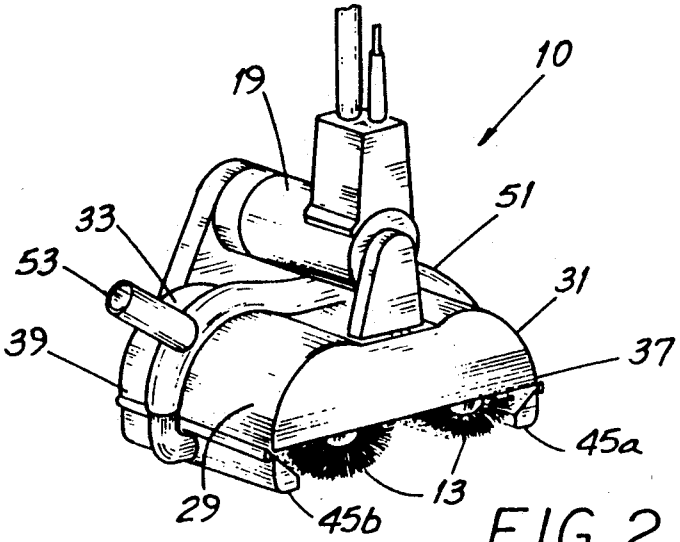
FIG. 2 is an elevation perspective view similar to that of FIG. 1 but showing the side of the machine opposite that shown in FIG. 1.
Figure 1:
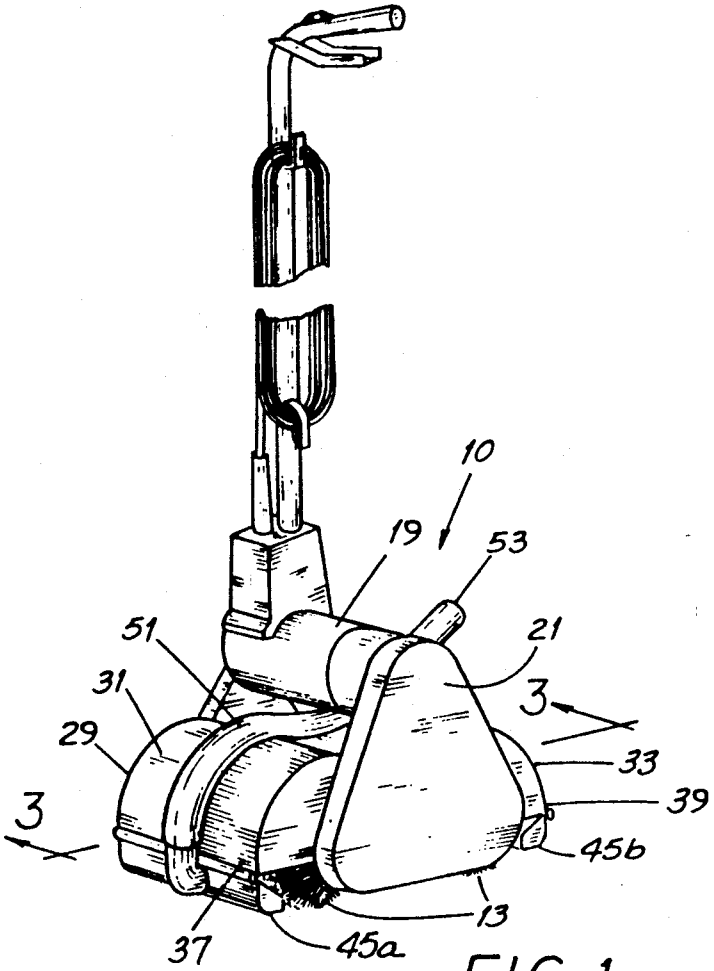
FIG. 1 is an elevation perspective view of the inventive machine

As best seen in FIGS. 1 and 2, each portion of the shroud 29 has a width and the length of each nozzle 45 is about equal to the width of the shroud 29. By extending the nozzles 45 across the full width of the shroud 29, granules 11 are more quickly recovered during vacuuming.

Each nozzle 45 also includes an inner lip 57 which is in a closely-proximate, non-contacting relationship to a brush 13 when the inlet 55 of the nozzle 45 is positioned in a granule passage 43. Two benefits result from this arrangement. One is that the nozzle 45 is more apt to catch granules moving along a passage 43 and emerging at an exit opening 41. Another benefit is that the amount of vagrant air (air from a source other than a passage 43) drawn into a nozzle 45 is reduced. Reducing the amount of "ingested" vagrant air helps maintain the velocity of the air stream flowing along the passage 43 and the effectiveness of the machine 10 as a vacuum cleaner is thereby improved.

As best seen in FIGS. 3A and 4, each nozzle also includes a lower lip 59 in air-flow restricting relationship to the carpet 12 when the nozzle 45 is positioned for vacuuming granules 11. Restriction of the flow of air between the lower lip 59 and the carpet 12 also aids in reducing the amount of vagrant air drawn under the nozzle 45, over the inner lip 57 and into the inlet 55. Air flow is restricted when the lower lip 59 is in a closely proximate, non-contacting relationship to the carpet 12 or lightly contacts the carpet 12.

The opening of each nozzle 45 generally defines a plane 61. This plane 61 is oriented to face generally upward into a passage 43 to intersect the trajectories of granules 11 moving through the passage 43. When so arranged, a nozzle 45 could be described as an elongate "basket" which "catches" granules 11 during vacuuming.

As shown in FIGS. 1, 2, 3A and 4, each nozzle 45 is attached at an edge 37, 39 by a coupler 63 embodied as a hinge mechanism. Such coupler 63 is permanently attached or, in the alternative, is arranged to permit easy attachment and detachment using pins 65 which may be inserted or withdrawn as with a conventional hinge.

Each nozzle 45 includes an aperture 67 for connecting the nozzle 45 to a conduit 51. After each nozzle 45 is in place for vacuuming (as shown in FIGS. 1, 2 and 3A), the nozzles 45 are coupled to the conduit 51 by the insertion of coupling elbows 49. The lower end of each elbow 49 is inserted into the aperture 67 and the upper end inserted into the conduit 51.

Figure 5:
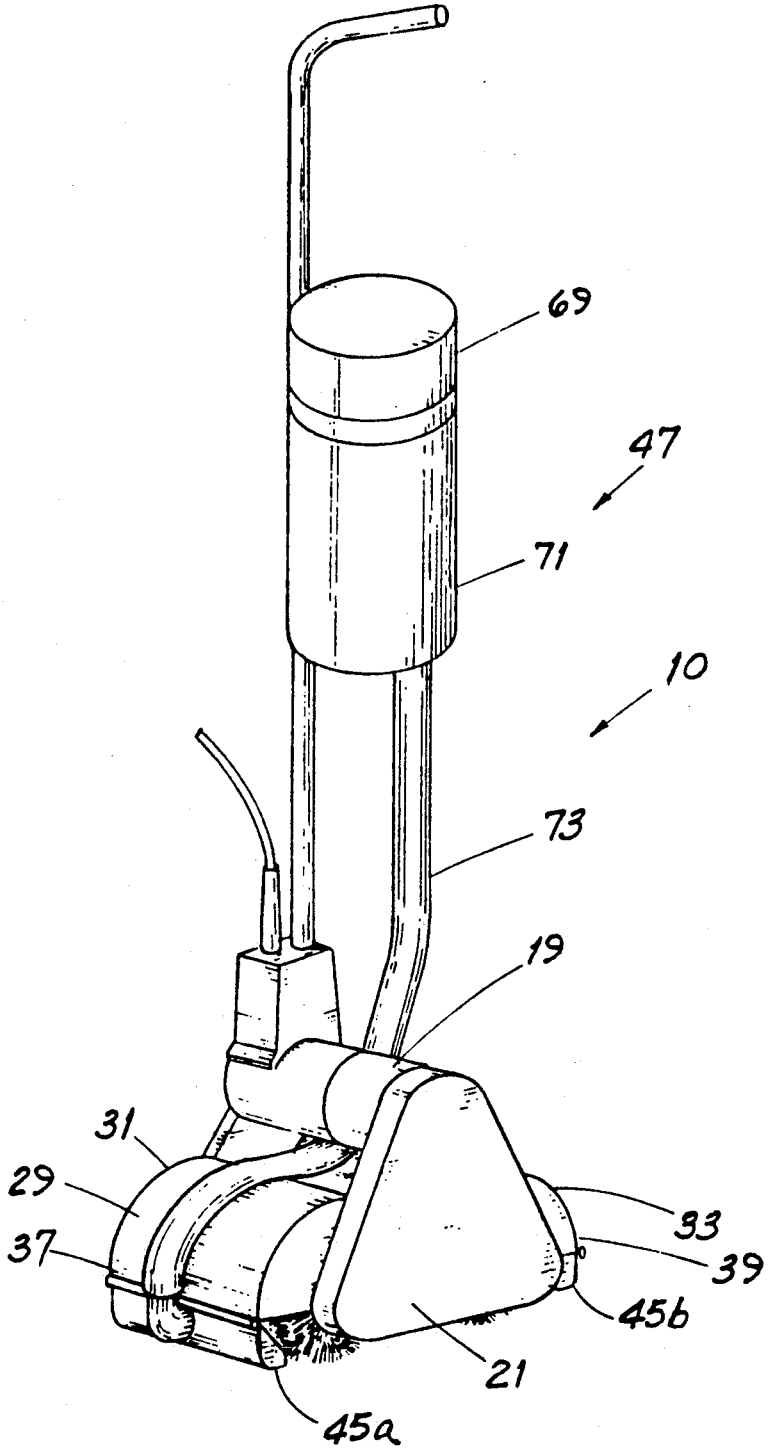
FIG. 5 is a simplified perspective view of the machine shown with a self-mounted, separately-operable vacuum unit.

In a highly preferred embodiment, the nozzles 45 operate simultaneously and independent of the operation of the brushes 13. Vacuum for the nozzles 45 is provided by a vacuum-creating machine 47 As shown in FIG. 5, the vacuum-creating machine 47 is embodied as a separate electric motor 69 and collector housing 71 mounted on the machine 10. The collector housing 71 is attached to the connector 53 by a hose 73.

Figure 6:
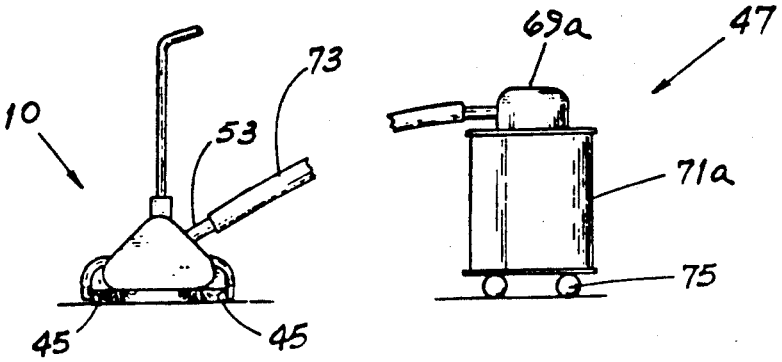
FIG. 6 is a simplified side elevation view of the machine shown in conjunction with a separate vacuum-creating machine connected thereto by flexible hose.

As shown in FIG. 6, the vacuum-creating machine 47 is embodied as a separate, free-standing machine attached to the connector 53 of the machine 10 by a flexible hose 73. Such machines are typically mounted on wheels 75 and have a separate collector tank **71*a* and a separate electric vacuum motor 69*a***.

Figure 7:
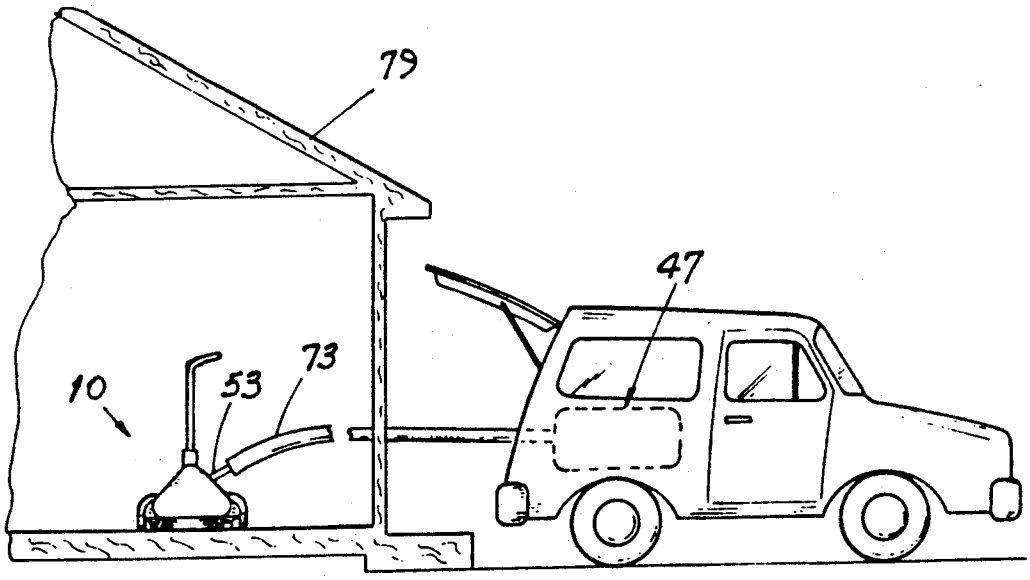
FIG. 7 is a simplified side elevation view, partly in cross section, of the machine shown in conjunction with a separate vacuum-creating machine (in dotted outline) mounted on a motor vehicle.

Yet another arrangement is shown in FIG. 7 wherein the vacuum-creating machine 47 is mounted on a motor vehicle 77 and is powered by its own drive motor or by the vehicle engine, neither being shown. When using the arrangement of FIG. 7, a flexible vacuum hose 73 extends from the vehicle through a door or window of the building 79 in which the machine 10 used.

Irrespective of the particular embodiment of the vacuum-creating machine 47, it should provide a vacuum of about 82–103 inches water at the connector 53 and an air flow rate of about 100 to 120 cu. ft. per minute for most effective cleaning. The foregoing assumes the machine 10 has a "footprint" area on the carpet 12 of about 180 sq. in.

To use the inventive machine 10, the dry carpet cleaning granules 11, preferably those used in the HOST® system, are distributed atop the carpet 12. The nozzles 45 are placed in the raised position (or removed) to avoid obstructing the exit openings 41.

Thereupon, the motor 19 is energized to drive the brushes 13 and the machine 10 worked across the carpet 12 to thoroughly brush the granules 11 into, through and across the carpet fibers 16, thereby thoroughly cleaning such fibers 16. During this cleaning operation, no vacuum is used.

After cleaning (or when the machine 10 is used for vacuuming without prior cleaning—a use for which it is very effective), the nozzles 45 are lowered (or installed) to be in close proximity to or lightly touch the carpet 12, thereby obstructing the granule exit openings 41. Then the motor 19 and the vacuum-creating machine 47 are energized. The machine 10 is then passed over the surface of the carpet 12 to remove the dirt-ladened granules 11.

It has been found that the inventive machine 10 removes substantially all of the granules 11 from short-tufted commercial carpets 12. It has also been found that the machine 10 removes a much higher percentage of granules 11 from longer-tufted residential carpets 12 than do conventional commercial vacuum cleaners. Further, such thorough granule removal is accomplished in about one-half the time otherwise required to remove fewer of the granules 11 using a conventional carpet vacuuming machine. Labor costs are thereby reduced.

Another advantage of the machine 10 is that the individual engaged in cleaning carpets 12, typically a professional carpet cleaner, need only purchase, store and move a single machine 10 from job to job rather than two separate machines. Thus, the machine 10 provides a significant savings in initial investment and time.

The preferred machine 10 is devoid of separate support wheels. That is, the brush bristles 15 are relatively stiff and substantially continuously disposed about the brush 13. Such bristles 15 deflect only slightly during machine operation and the machine 10 is supported entirely by the counter-revolving brushes 13 when in operation.

While the principles of this invention have been described in connection with specific embodiments, it should be understood clearly that these descriptions are made only by way of example and are not intended to limit the scope of the invention.

What is claimed is:

1. An improved machine for cleaning a carpet made of fibers, such machine selectively substantially-dry cleaning granules into and across the carpet and removing such granules therefrom, the machine including:

a pair of counter-revolving brushes for stroking the granules into and across the carpet fibers, such brushes including a front brush and a rear brush;

a shroud mounted adjacent the brushes and having a front portion and a rear portion, each such portion being spaced from its adjacent brush to define a granule passage through which granules cast by the counter-revolving brushes are re-deposited on the carpet, each such portion further having an edge spaced above the carpet to define a granule exit opening therebetween;

a front vacuum nozzle and a rear vacuum nozzle, each nozzle having an inlet for receiving granules to be removed from the carpet, each such inlet being selectively positionable at a granule exit opening, to thereby selectively substantially block a granule exit opening:

whereby such granules may be worked into and re-distributed for cleaning the carpet and thereupon removed by vacuuming upon completion of carpet cleaning.

2. The machine of claim 1 wherein each portion of the shroud has a width, wherein each nozzle has a length and wherein the length of each nozzle is about equal to the width of the shroud.

3. The machine of claim 2 wherein each nozzle has an inner lip which is in a closely-proximate, non-contacting relationship to a brush when the inlet of the nozzle is positioned in a granule passage.

4. The machine of claim 3 wherein each nozzle is pivotably coupled to the machine at a separate edge of the shroud, each nozzle thereby being mounted for selective positioning of its inlet in a granular passage.

5. The machine of claim 4 wherein each nozzle generally defines a plane, wherein granules move through each passage along trajectories and wherein such plane is oriented to intersect such trajectories, thereby catching granules in the nozzle.

6. The machine of claim 5 wherein each inlet is selectively positionable in a granule passage by detachable attachment of the nozzle to an edge of the shroud.

7. The machine of claim 6 wherein the vacuum nozzles operate simultaneously and are operable independent of the operation of the brushes.

8. The machine of claim 1 wherein each nozzle includes a lower lip in air-flow restricting relationship to the carpet when such nozzle is positioned for vacuuming granules, thereby preventing impairment of the velocity of the air stream in the passages.

9. The machine of claim 8 wherein the inlet of each nozzle faces upwardly into a passage.

10. The machine of claim 9 wherein such lower lip is in closely proximate, non-contacting relationship to the carpet.

11. The machine of claim 9 wherein such lower lip is in contact with the carpet.

12. The machine of claim 8 wherein each of the brushes has bristles, wherein such bristles are relatively stiff and substantially continuously disposed about the brush, wherein the bristles deflect only slightly during machine operation and wherein the machine is supported substantially entirely by the counter-revolving brushes when in operation, thereby making such machine easier to push across a carpet.

13. The machine of claim 1 wherein the counter-revolving brushes are driven by a motor and wherein each nozzle has a vacuum capability provided by a motor separate from that used to drive the brushes.

14. The machine of claim 13 wherein the motor providing the vacuum capability is mounted on the machine.

15. The machine of claim 13 wherein the vacuum capability of the nozzles is provided by a separate vacuum-creating machine connected to the carpet cleaning machine by a flexible hose.

16. The machine of claim 15 wherein such vacuum-creating machine is mounted on a motor vehicle.

17. The machine of claim 1 wherein each of the brushes has bristles, wherein such bristles are relatively stiff and substantially continuously disposed about the brush, wherein the bristles deflect only slightly during machine operation and wherein the machine is supported substantially entirely by the counter-revolving brushes when in operation, thereby making such machine easier to push across a carpet.

* * * * *

UNITED STATES PATENT AND TRADEMARK OFFICE

CERTIFICATE OF CORRECTION

PATENT NO. : 5,077,862

DATED : January 7, 1992

INVENTOR(S) : Geoffrey B. Rench

It is certified that error appears in the above-identified patent and that said Letters Patent is hereby corrected as shown below:

In column 2, line 6, after "operation" insert a --.--.

In column 2, line 18, after "nozzles" insert a --.--.

In column 2, line 26, after "machines" insert a --.--.

In column 2, line 41, after "brushes" insert a --.--.

In column 2, line 49, after "surface" insert a --.--.

In column 3, line 25, after "surface" insert a --.--.

In column 3, line 56, after "cleaning" insert a --.--.

In column 4, line 26, after "cleaning" insert a --.--.

In column 4, line 62, after "passage" insert a --.--.

In column 5, line 45 after "machine" insert a --.--.

In column 6, line 16, after "solvents" insert a --.--.

In column 6, line 29, after "movement" insert a --.--.

In claim 1, line 48, delete "selectively" and insert --stroking--.

Signed and Sealed this

Thirtieth Day of March, 1993

*Attest:*

STEPHEN G. KUNIN

*Attesting Officer*

*Acting Commissioner of Patents and Trademarks*